US006508458B1

(12) United States Patent
Bartlett et al.

(10) Patent No.: US 6,508,458 B1
(45) **Date of Patent: *Jan. 21, 2003**

(54) RAIL AND SUPPORTS THEREOF

(75) Inventors: Gary F. Bartlett, Muncy, PA (US); James G. Fenstermacher, Hughesville, PA (US)

(73) Assignee: Construction Specialities, Inc., Lebanon, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/871,204

(22) Filed: May 31, 2001

Related U.S. Application Data

(63) Continuation-in-part of application No. 09/767,005, filed on Jan. 22, 2001.

(51) Int. Cl.[7] ..... E04H 17/14; E04H 17/24

(52) U.S. Cl. ..... 256/65.08; 256/59; 256/65.16; 403/19; 403/374.1

(58) Field of Search ..... 256/65.01, 65.02, 256/65.16, 69, 59

(56) References Cited

U.S. PATENT DOCUMENTS

| | | | | | |
|---|---|---|---|---|---|
| 3,286,850 | A | * | 11/1966 | Ruhnke | 211/105.1 |
| 3,372,909 | A | * | 3/1968 | Attaway | 256/21 |
| 3,544,072 | A | * | 12/1970 | Thom | 256/59 |
| 3,825,229 | A | * | 7/1974 | Bartlett et al. | 248/251 |
| 4,200,261 | A | * | 4/1980 | Bartlett | 248/345.1 |
| 4,353,529 | A | * | 10/1982 | Brown | 248/345.1 |
| 4,650,164 | A | * | 3/1987 | Shepherd | 256/65.16 |
| 5,155,960 | A | * | 10/1992 | Shaanan | 24/580.11 |
| 5,165,643 | A | * | 11/1992 | Shreiner | 248/251 |
| 5,427,359 | A | * | 6/1995 | Moulton | 256/59 |
| 5,551,194 | A | * | 9/1996 | Toomey | 256/65.16 |
| 5,743,064 | A | * | 4/1998 | Bennett | 256/59 |
| 5,908,185 | A | * | 6/1999 | Collette et al. | 348/245.1 |
| 6,386,518 | B1 | * | 5/2002 | Shreiner | 403/374.1 |

FOREIGN PATENT DOCUMENTS

| | | | | |
|---|---|---|---|---|
| JP | 03260256 A | * | 11/1991 | E04F/11/18 |
| JP | 406017520 | * | 1/1994 | 256/59 |

OTHER PUBLICATIONS

"C/S Acrovyn®"catalog, C/S Group, 2001, pp. 16, 17, 18, 19, 20, 21.

* cited by examiner

*Primary Examiner*—Lynne H. Browne
*Assistant Examiner*—Jori Schiffman
(74) *Attorney, Agent, or Firm*—Baker Botts LLP

(57) ABSTRACT

A rail has an axially extending undercut groove of a uniform generally "C" shape in cross section and is supported by supports attached to the rail in spaced-apart relation. Each support includes a bracket and a lock member attached to the bracket for rotation and against displacement of the lock member relative to the bracket member. The lock member includes a locking cam portion, which is received in the undercut groove and has a size and shape such that it can enter the undercut groove when it is in an unlocked rotational position relative to the undercut groove and such that it frictionally engages walls of the undercut groove in a locked rotational position relative to the undercut groove and thereby retains the rail against displacement relative to a structure that supports the rail.

18 Claims, 9 Drawing Sheets

RAIL AND SUPPORTS THEREOF

CLAIM FOR PRIORITY

The present application is a continuation-in-part of U.S. patent application Ser. No. 09/767,005, filed Jan. 22, 2001.

BACKGROUND OF THE INVENTION

The present invention relates to elongated rails, such as handrails, of the type that are mounted on walls, posts, or other structures by a number of spaced-apart supports.

Construction Specialties, Inc., the assignee of the present invention, makes and sells a line of wall protection products under the trademark ACROVYN®. The ACROVYN® line includes several styles of handrails that have extruded aluminum retainers and in some cases covers of polyvinyl chloride (PVC) blended with a small amount of an acrylic polymer that are mounted on the retainers. The retainers provide the strength and rigidity for the support of persons who use the handrails for assistance and also endure impacts of objects that strike the handrails. The covers provide durable and attractive surfaces to the exposed parts of the handrail. Some styles of the ACROVYN® line include wood components, such as handgrips and crash rails, that are mounted on the retainers. Handrails similar to the ACROVYN® handrails are available from several suppliers.

Virtually all types of handrails are supported in spaced-apart relation to the walls or posts by which they are supported so as to leave a space between the handgrip portion of the handrail and the wall for the user's fingers. In most cases, the supports are individual brackets that are strongly attached to the walls and the handrails so as to be able to both carry the loads of persons who use the handrail for assistance and to endure impacts from objects that strike the handrail forcefully. There are advantages to using for each support a single bolt that passes through a hole in a portion of the handrail, a hole in a bracket member that provides the desired spacing between the handrail and the wall (or post) surface and spreads the applied loads over a suitably large area of the wall (or post) surface, and through the wall (or post) to a suitable anchor, such as a toggle nut. The single bolt for each support provides a unitary, structurally sound and reliable connection and avoids the complexity and tediousness of installation of multiple fasteners at each support location. On the other hand, the holes in the handrail and the wall have to be drilled on site so that they will be aligned, which is time-consuming. In some cases, the head of the bolt remains visible in the final installation or is concealed by installing a plug.

In handrails that have extruded aluminum retainers and covers of polymeric materials or components of wood, metal or other materials attached to the retainer, the covers or other components are installed only after the retainers are mounted on the wall (or posts) and both conceal the heads of the bolts and make them inaccessible. If it becomes necessary to remove the handrail, the covers and/or other components affixed to the retainers have to be removed.

SUMMARY OF THE INVENTION

An object of the present invention is to provide a rail installation, such as a handrail installation, in which single bolts are used at each support point for the rail and in which the rail need not be drilled to fasten it to the support. Another object is to provide a rail and supports therefor that permit covers and/or other components to be pre-assembled to the rail before the rail is attached to the supports. Similarly, it is a further object to permit all of the supports for the rail to be installed on the wall or post system (or other supporting structure) before the rail is installed. Still another object of the present invention is to provide supports for a rail in which the heads of the fasteners are concealed from normal view but are accessible without any disassembly of the rail and covers or other components associated with the rail.

The foregoing objects are attained, in accordance with the present invention, by a rail and supports therefor that include an elongated rail having an axis, an undercut groove of a uniform generally "C" shape in cross section extending axially along the rail, and a plurality of supports attached to the rail in spaced-apart relation. Each support has a bracket member having a supported surface adapted to engage a structure on which the rail is mounted and having a supporting surface spaced apart from the supported surface and a lock member received on the supporting surface of the bracket member. The lock member includes a locking cam portion, which is received in the undercut groove, and has a size and shape such that it can enter the undercut groove when it is in an unlocked rotational position relative to the undercut groove and such that it frictionally engages walls of the undercut groove in a locked rotational position relative to the undercut groove and thereby retains the rail against displacement relative to the structure. A fastener joins the lock member to the bracket member against displacement of the lock member relative to the bracket member and for rotation of the lock member relative to the bracket member.

The rail and supports, according to the invention as described generally thus far, have the very significant advantage over many previously known rail supports of permitting all of the supports for a length of rail to be installed on a wall, posts or other structure independently of the rail. The supports need not be installed precisely lengthwise of the rail in order to ensure register of holes in the rail with the supports, as is required in many previously known rail and support structures—the undercut groove can accept the lock members at any locations lengthwise of the rail. After all of the supports are installed, the rail is assembled to the supports by simply inserting the undercut groove of the rail onto the lock members of the supports, which are then in unlocked positions for acceptance of the locking cam portions by the undercut groove. The installer then rotates each lock member into the locked position, in which the rail is held firmly in place on each support by frictional engagement of the locking cam portion of the lock member with the undercut groove of the rail. If the rail or one or more of the supports requires repair, the rail is very easily and quickly removed from the supports by rotating the lock members to their unlocked positions and separating the rail from the lock members.

In many cases, the lock member of each support will include a mounting base portion engaging the supporting surface of the bracket member and a shank portion intermediate the locking cam portion and the mounting base portion. It is desirable for the lock member to have a tool-receiving formation on a portion thereof, such as the shank portion, externally of the undercut groove adapted to receive a tool for use to facilitate rotating the lock member. The tool-receiving portion may, for example, be a peripheral surface of the lock member having facets adapted to be engaged by a wrench.

The undercut groove of the rail may have walls forming recesses that face each other, and the locking cam portion of the lock member of each support correspondingly includes locking portions that frictionally engage the walls forming the recesses in the locked position of the lock member. The locking cam portion of the lock member of each support further includes a tapered lead-in portion adjacent each of the locking portions, the lead-in portions serving to guide the locking portions into engagement with the walls forming the recesses of the undercut groove upon rotation of the lock member from the unlocked position to the locked position. It is preferred that the lock member be unitary and a moldment of a solid polymeric material, such as nylon. Other materials, including metals, can be used for the lock member. As an optional but desirable feature, the lock member and bracket member of each support may have interacting detents establishing the unlocked and locked positions of the lock member.

As a further and desirable refinement, the undercut groove of the rail has spaced apart L-shaped flanges having inturned lip portions forming recesses that face each other. The locking cam portion of the lock member of each support includes locking portions that frictionally engage the recesses in the locked position of the lock member. The shank of the lock member includes a shoulder-forming part and a groove-forming part configured such that when the lock member is in the locked condition segments along the upper and lower ends of the shoulder-forming part engage rear surfaces of lip portions of the inturned flanges and the inturned lip portions of the flanges of the retainer are received in upper and lower grooves formed between front surfaces of the locking portions of the locking cam portion of the lock member and rear surfaces of the shoulder-forming part.

In advantageous embodiments, the front surfaces of locking portions of the locking cam portion of the lock member engage upper and lower portions of a base surface of the undercut groove at engagement regions, and the front surfaces of the locking cam portion have protuberances that are elastically compressed and provide preloads for maintaining the locking cam portion in firm engagement within the recesses In addition to fastening the fastener of each support to the bracket, the fastener may also serve to fasten the bracket member to the structure. For good appearance, the fastener of each support may be received within the bracket member along its entire extent between the supported surface and the supporting surface.

In advantageous embodiments, the bracket member of each support includes a recessed socket in the supporting surface and the lock member includes a base portion received in nested relation in the socket. The recessed socket of the bracket member and the base portion of the lock member have interacting detents establishing the unlocked and locked positions of the lock member.

In some embodiments, the rail has a retainer of extruded aluminum and a cover of a polymeric material received on a portion of the retainer located to face away from the wall. The undercut groove is located on a portion of the retainer that faces toward the wall and is not covered by the cover, thus to provide access to the lock member when the cover is assembled to the rail. In such an arrangement, the cover can be installed on the retainer before the rail is installed on the supports, and the rail can be removed from the supports without having to remove the cover from the retainer.

For a better understanding of the invention, reference may be made to the following description of an exemplary embodiment of the present invention, taken in conjunction with the accompanying drawings.

Figure 9:
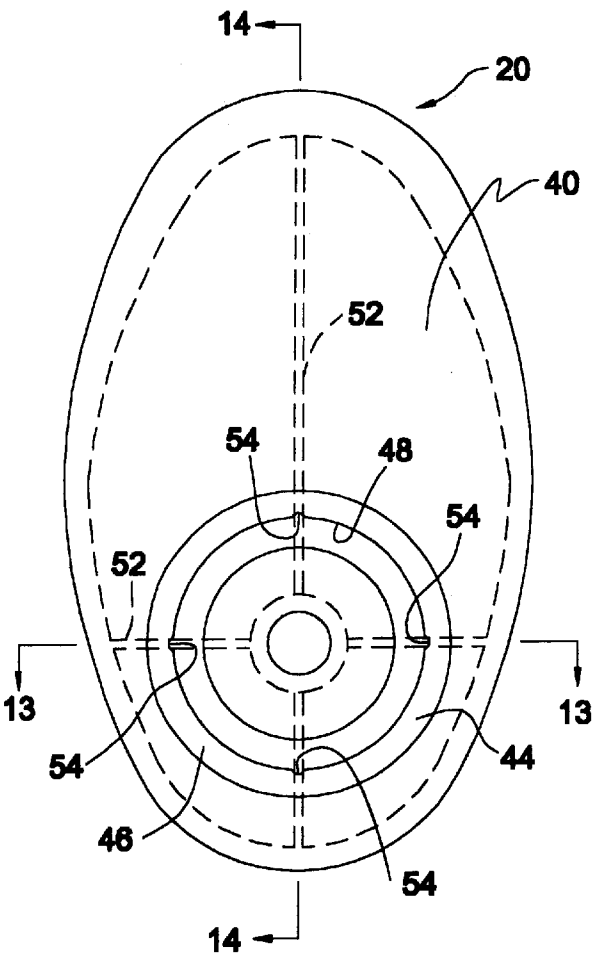
Figure 11:
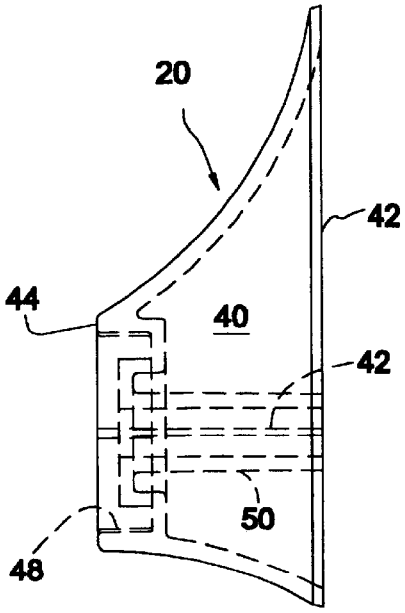
Figure 12:
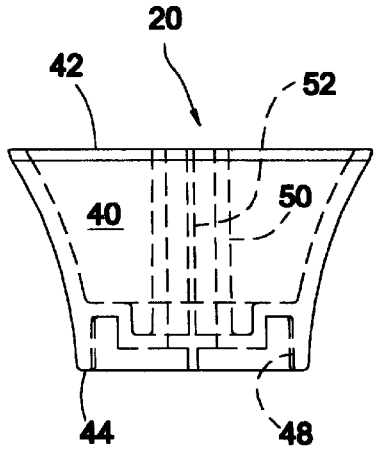
Figure 13:
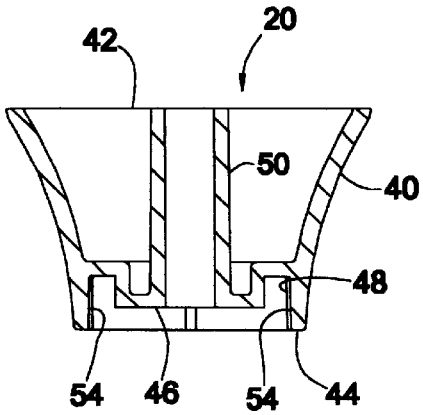
Figure 14:
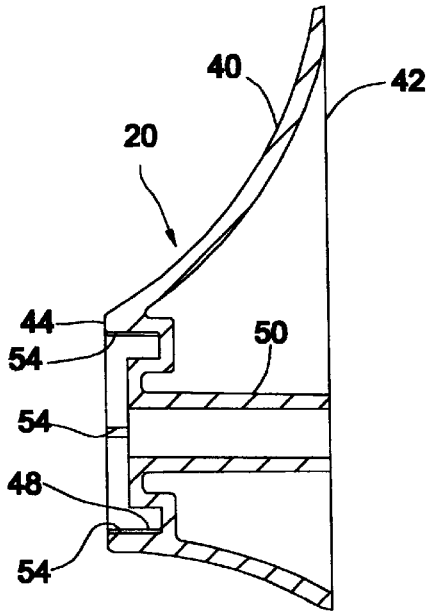
Figure 15:
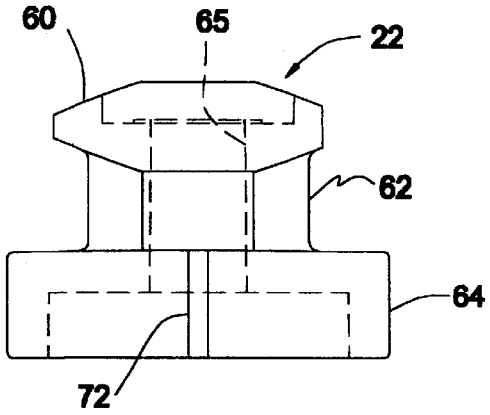
Figure 16:
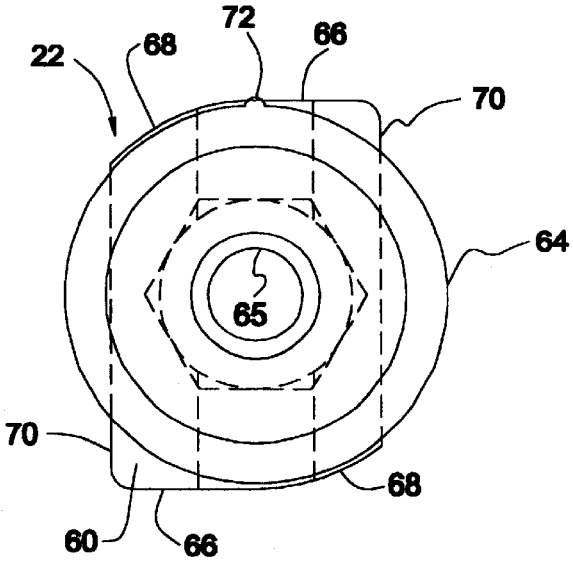
Figure 17:
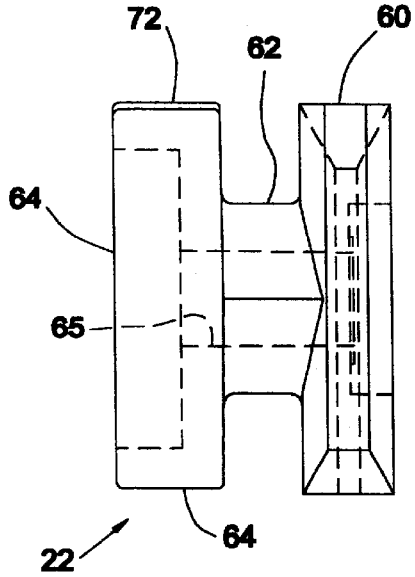
Figure 18:
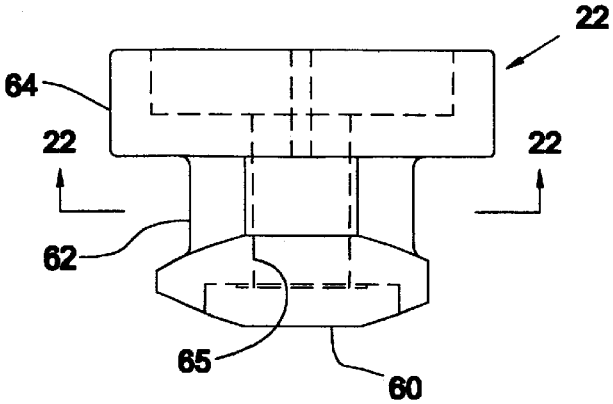
Figure 19:
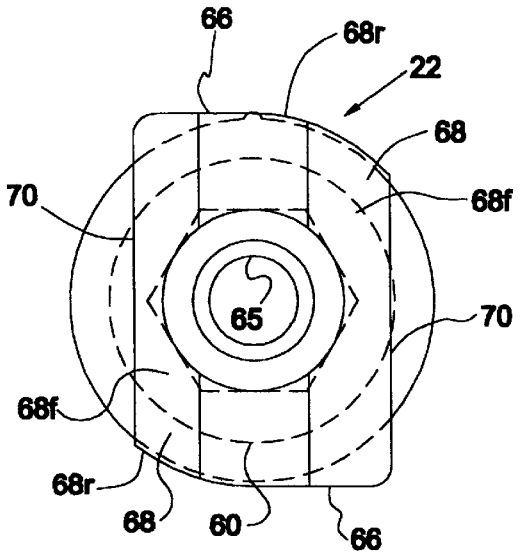
Figure 20:
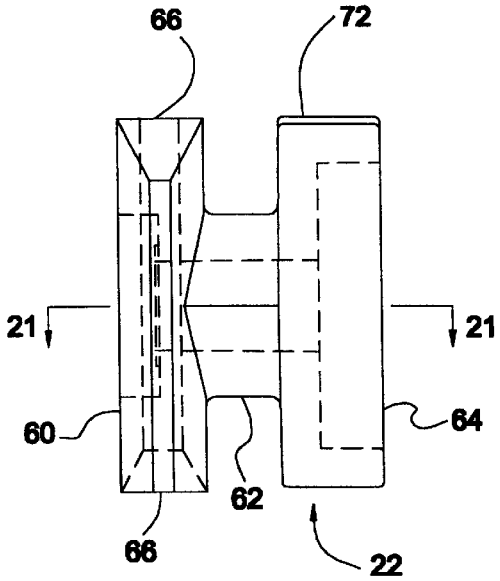
Figure 21:
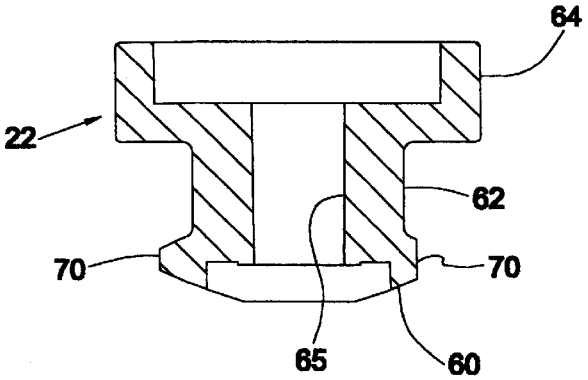
Figure 22:
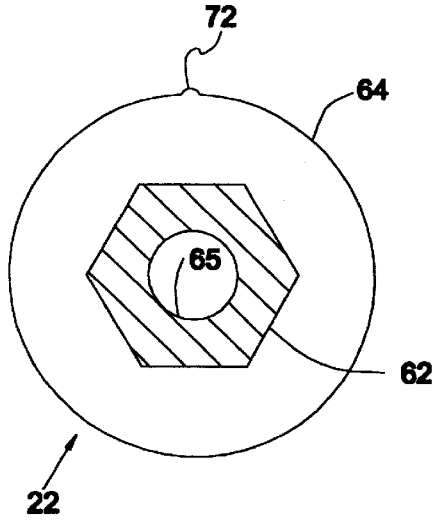
Figure 23:
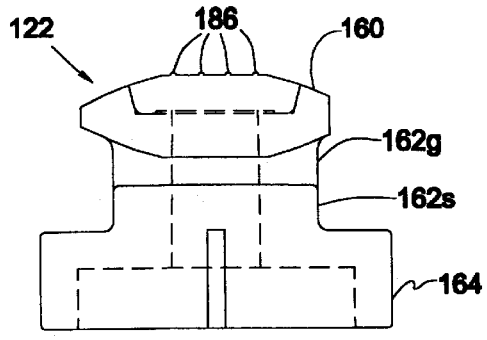
Figure 24:
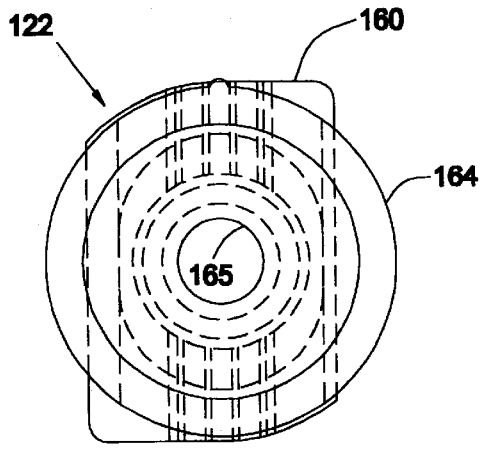
Figure 25:
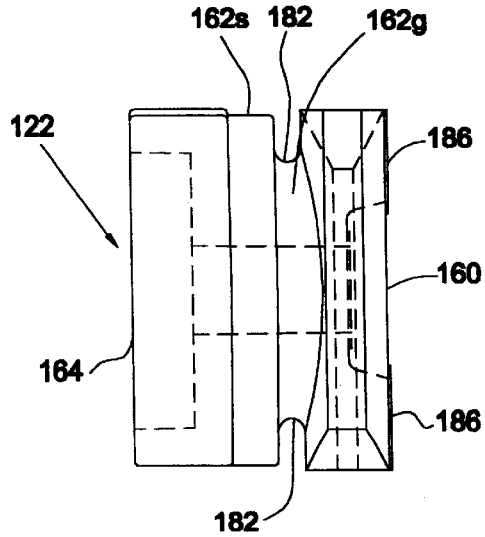
Figure 26:
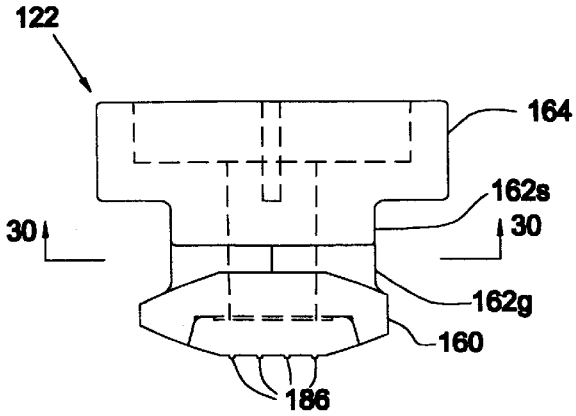
Figure 27:
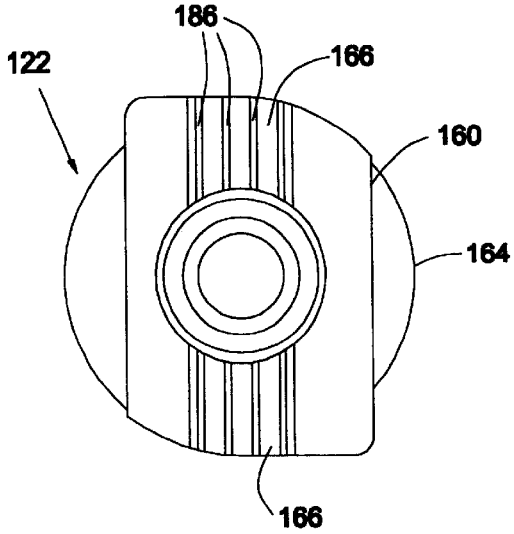
Figure 28:
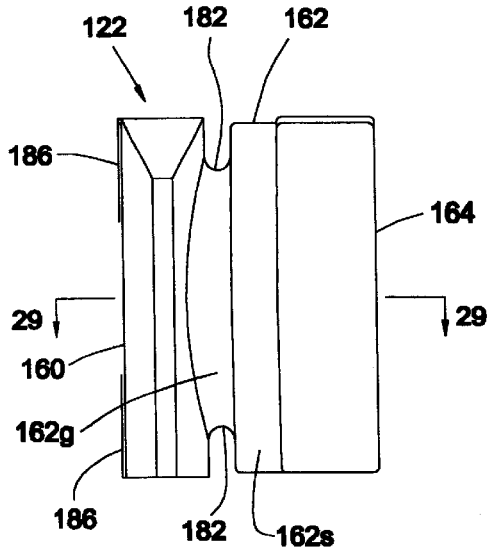
Figure 29:
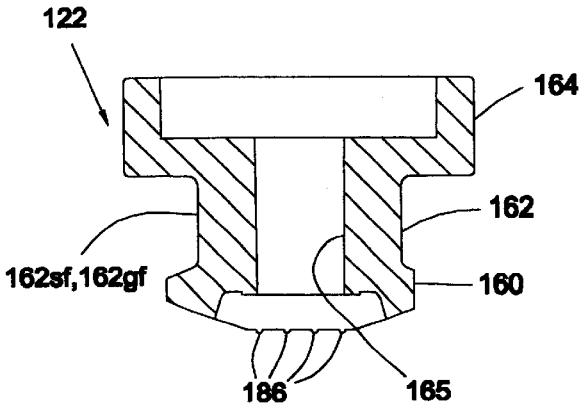
Figure 30:
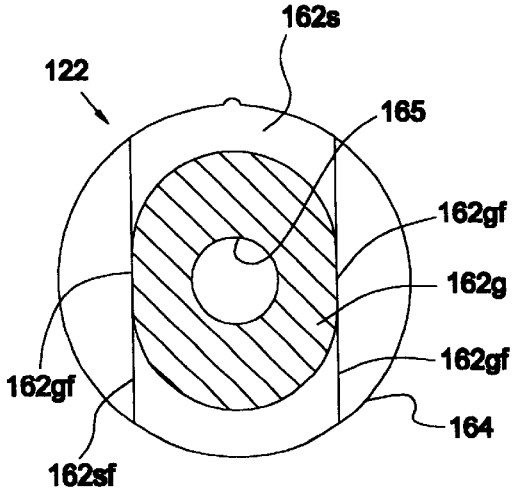

9—front elevational;

10—rear elevational;

11—right side elevational and a mirror image of the left side;

12—top plan;

13—top cross sectional along the lines 13—13 of FIG. 9;

14—side cross-sectional along the lines 14—14 of FIG. 9;

FIGS. 15 to 22 are views of the lock member, as follows:

15—top plan;

16—rear elevational;

17—left side elevational;

18—bottom plan;

19—front elevational;

20—right side elevational;

21—top cross sectional along the lines 21—21 of FIG. 20;

22—rear cross sectional along the lines 22—22 of FIG. 18;

FIGS. 23 to 30 are views of a modified lock member, as follows:

23—top plan;

24—rear elevational;

25—left side elevational;

26—bottom plan;

27—front elevational;

28—right side elevational;

29—top cross sectional along the lines 29—29 of FIG. 28;

30—rear cross sectional along the lines 30—30 of FIG. 26; and

Figure 31:
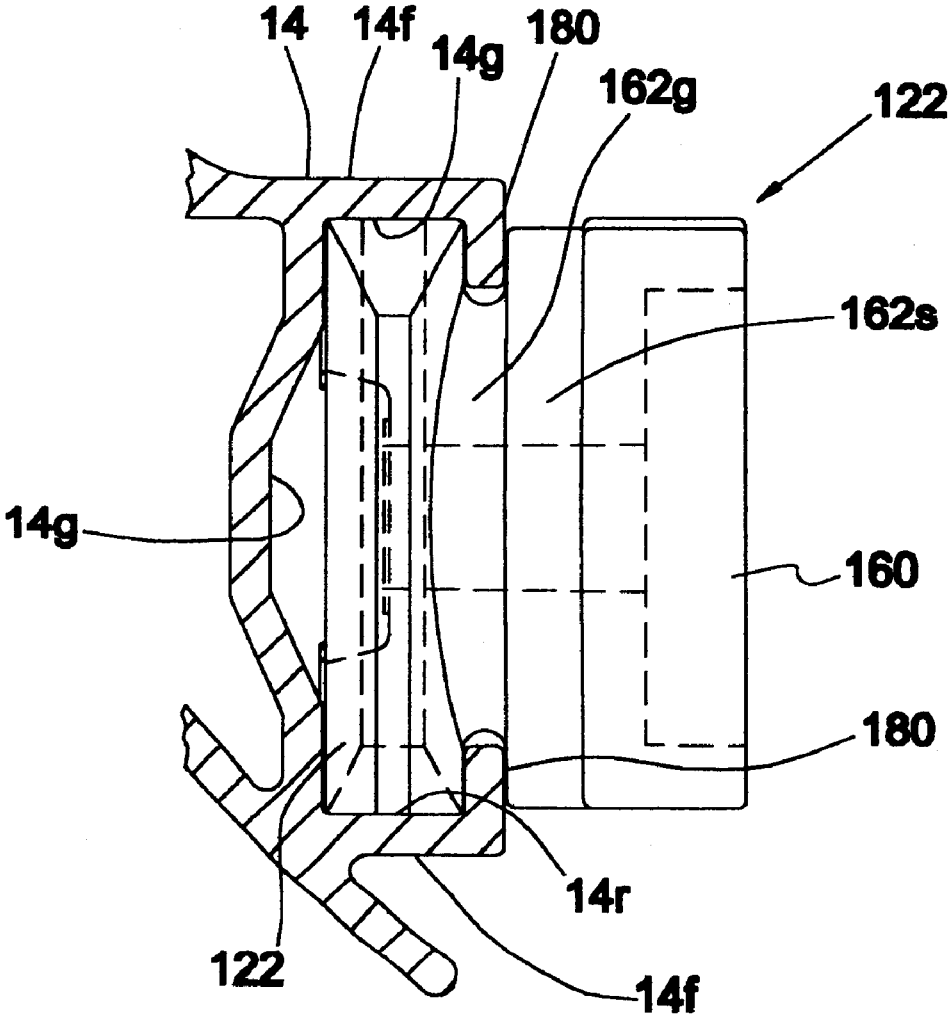

FIG. 31 is a detail right end cross-sectional view showing the lock member of FIGS. 23 to 30 in the locked condition in the undercut groove of the retainer.

DESCRIPTION OF THE EMBODIMENT

Figure 1:
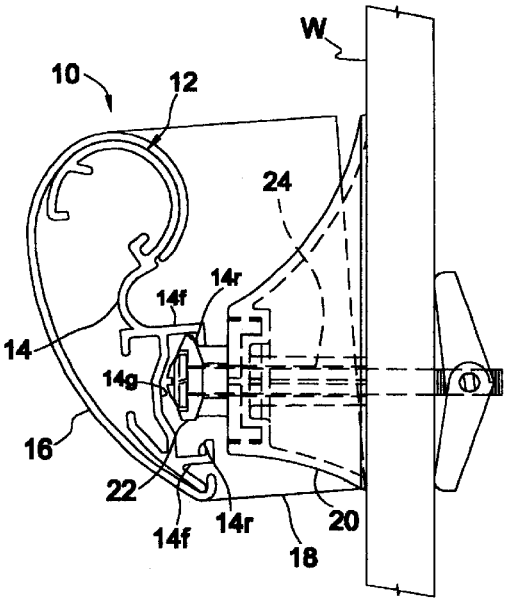
FIG. 1 is a right end cross-sectional view of a handrail, which is shown loosely positioned on one of a plurality of supports in a state in which it is ready to be affixed to the supports.
Figure 2:
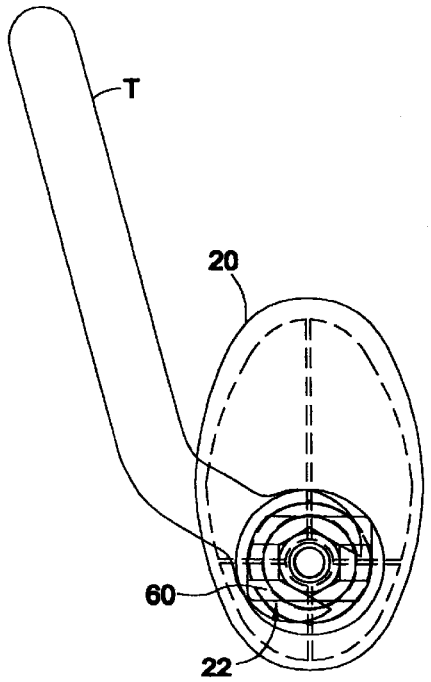
FIG. 2 is a front elevational view of the support of FIG. 1, showing it in a state in which it is ready to be mounted on a structure and to accept a rail for affixation to the structure.
Figure 3:
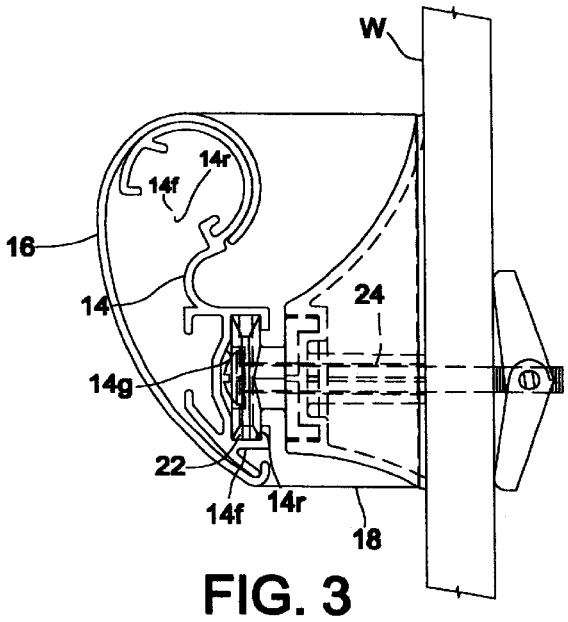
FIG. 3 is a right end cross-sectional view of the handrail and support of FIG. 1, showing the handrail affixed to the support.

The rail and supports 10 shown in FIGS. 1 to 3 serve as a handrail when installed on a structure, which in most cases is wall W. The rail (here a handrail) 12 is formed by an extruded aluminum retainer 14 and a cover 16 of an impact-resistant, substantially rigid polymeric material, such as polyvinyl chloride blended with a small amount of an acrylic polymer. End pieces 18 attached to the longitudinal ends of the handrail 12 keep things from becoming caught on the otherwise exposed ends of the handrail. The handrail is mounted on the wall W by two or more supports located at a suitable longitudinal spacing. Each support includes a bracket 20, a lock member 22, and a fastener 24, such as a bolt and a toggle nut. FIG. 1 shows the handrail 12 loosely hanging on the lock member and ready for firm attachment to the support by rotating the lock member, as described below; FIG. 2 shows only the bracket 20 and the lock member 22 and also shows a tool T, an open end wrench in the embodiment, by which the lock member 22 is rotated from the unlocked position shown in FIG. 2 to the locked position; and FIG. 3 shows the lock member in the locked position and the rail firmly attached to the support.

Figure 4:
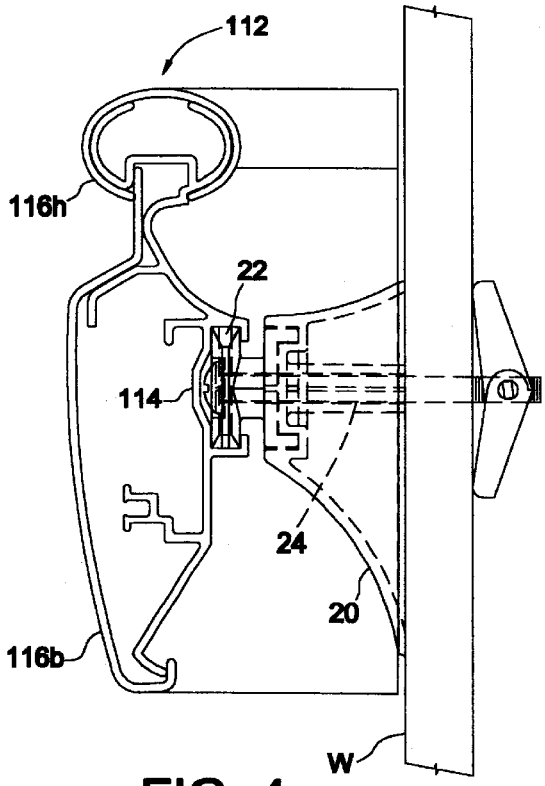
FIG. 4 is a right end cross-sectional view of the support of FIG. 1, showing a rail of a different construction from that of FIG. 1 affixed to the support, the support being inverted relative to FIGS. 1 to 3.

Handrails of the type shown in FIGS. 1 and 3 are well known, per se, and are available commercially from several sources in a variety of configurations. FIG. 4 shows, for example, a handrail 112 in which the retainer 114 receives a handgrip cover 116*h* and a bumper cover 116*b*. The supports for the handrail of FIG. 4 are the same as those of FIGS. 1 to 3, except that the brackets 20 are installed in an inverted position, relative to handrail of FIGS. 1 to 3. The handrails 12 and 112 are designed not only to provide support for persons but to absorb impacts from objects that might otherwise hit the wall and mar or damage it. The durable PVC covers resist marring and are moderately resilient so that they deform when impacted to absorb some of the energy of an impact, the covers being mounted on the retainers in a manner that permits displacement of at least one portion that engages the retainer.

In the illustrated embodiment, the bracket 20 is molded from a rigid, strong polymeric material, such as PVC. As shown in detail in FIGS. 9 to 14, it includes an outer shell 40 having a relatively large supported end 42 that engages the wall or other structure over a relatively large area for load distribution and a relatively small supporting end 44 to which the rail is attached. A hub 46 at the supported end includes a recessed stepped socket 48, from which a sleeve 50 that receives the shank of the bolt 24 extends within the shell to the supported end 42. Stiffening webs 52 extend between the sleeve 50 and the shell 40. Each of four shallow grooves 54 in the perimeter wall of the socket 48 is an element of a detent that locks the lock member in its unlocked and locked position, as the case may be.

A bracket for the support of the rail and support of the present invention can, of course, be of various shapes, made of various materials, and designed to be attached in various ways to a rail and to a wall or other structure. In the embodiment, the shank of the bolt is received entirely within the bracket, which conceals it from view. The support according to the embodiment also uses a single bolt for both attaching the lock member to the bracket and the bracket to the wall, which minimizes the number of parts, provides a strong attachment, and facilitates installation.

The lock member 22 (see FIGS. 15 to 22) has a locking cam portion 60, a shank 62 and a mounting base portion 64 and is molded from a rigid, strong polymeric material, such as nylon. As mentioned above, the lock member can also be made of other materials, such as a metal. The lock member is configured to be received on the supporting end 44 of the bracket 20. In the embodiment, the mounting base portion 64 is shaped and sized to nest closely, though not tightly, in the socket 48 of the bracket so that it can be rotated. A countersunk hole 65 through the lock member 22 receives part of the head and part of the shank of the bolt 24.

The locking cam portion 60 of the lock member 22 has a size and shape such that it can enter a generally C-shaped undercut groove in the rail when it is in an unlocked rotational position relative to the undercut groove and such that it frictionally engages walls of the undercut groove in a locked rotational position relative to the undercut groove and thereby retains the rail against displacement relative to the structure.

In the embodiment, the retainer 14 (see FIG. 1) has L-shaped flanges 14*f* that define an undercut groove 14*g* and provide walls forming recesses 14*r* that face each other. The ends of the flanges 14*f* leave an opening into the groove 14*g* through which the locking cam portion 60 of the lock member 22 can pass when the lock member is in the unlocked position (see FIG. 1). In the locked position of the lock member, the surfaces of locking portions 66 of the cam portion 60 frictionally engage the walls forming the recesses 14*r* of the undercut groove and firmly attach the rail 12 to the support. A lead-in portion 68 adjacent each of the locking portions guides the corresponding locking portion 66 into engagement with the walls forming the recesses of the undercut groove upon rotation of the lock member from the unlocked position to the locked position. Each lead-in portion 68 is formed by tapered facets 68*f* on the front and back surfaces of the locking cam portion and rounded edges 68*r*, which widen progressively toward the locking portions 66. The dimension of the locking cam portion between the side edges 70 ("side" relative to the locked position) is greater than the width of the shank portion 62 but less than the height of the opening into the undercut groove 14*g* of the retainer 14 so that the locking cam portion 60 can be accepted into the undercut groove when the rail is installed and when accepted allows the rail to hang loosely from the locking cam portion (see FIG. 1).

Figure 5:
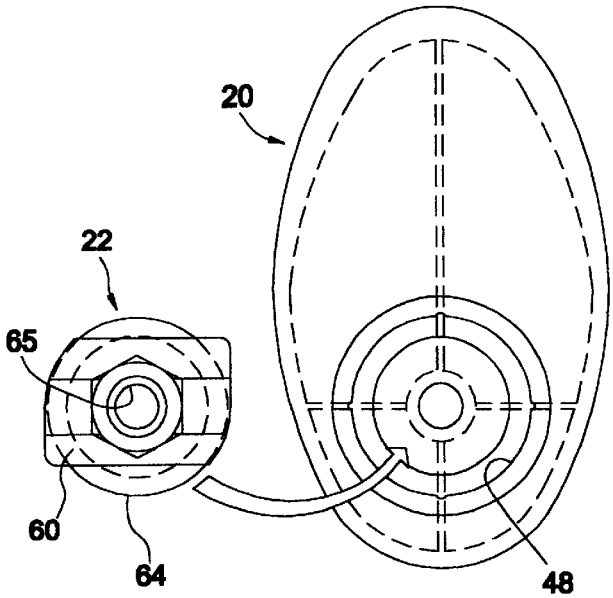
FIG. 5 is a front elevational view of the bracket member and lock member shown in FIGS. 1 to 4, showing how they are assembled.
Figure 6:
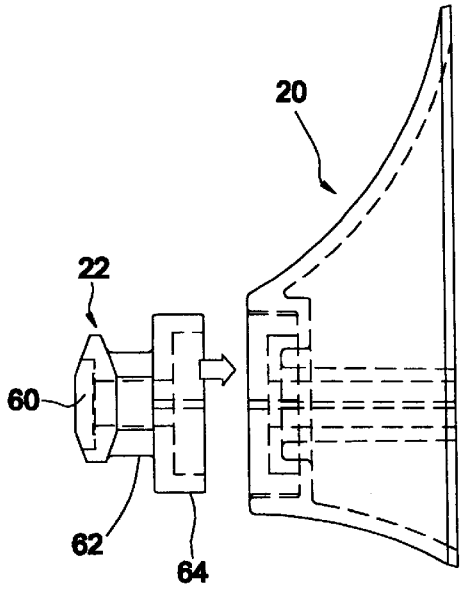
FIG. 6 is a right side elevational view of the bracket member and lock member shown in FIGS. 1 to 5, showing how they are assembled.
Figure 7:
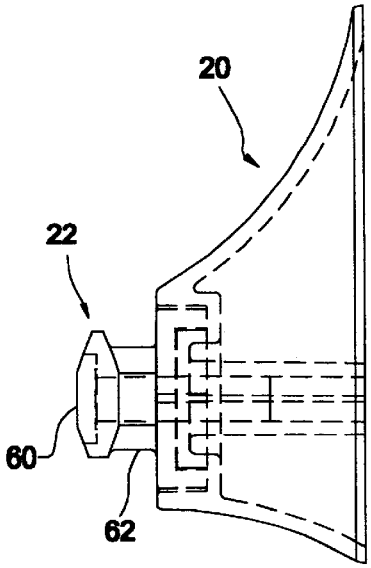
FIG. 7 is a right side elevational view of the bracket member and lock member shown in FIGS. 1 to 6, showing them assembled and showing the lock member in its unlocked position.

FIGS. 5 to 7, 1 to 3 and 8, in that order, depict the process of installing a rail and supports embodying the invention. As a first step, which is not shown, holes for the supports are laid out and drilled in the wall W (or other structure). As mentioned above, the holes need not be drilled with precision in the axial direction because it is not necessary for the holes in the walls to register with holes in the rail. The supports are installed at all locations by inserting a lock member 22 into the socket of each bracket 20 with the lock member in the unlocked position (FIGS. 5 to 7). The mounting base 64 of the lock member has a small rib 72, which serves as the other element of a detent by engaging one of the grooves 54 in the bracket 20 (see, e.g., FIGS. 9 and 16). The detent holds the lock member in the unlocked position during installation. All of the supports for the rail are attached to the wall W using the bolts 24 and toggle nuts (or other suitable fasteners (FIG. 1).

Figure 8:
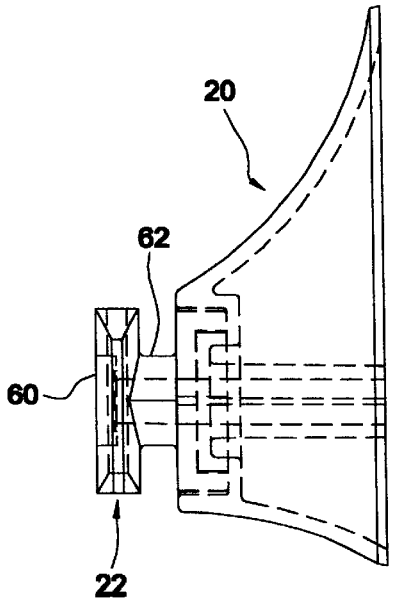
FIG. 8 is a right side elevational view of the bracket member and lock member shown in FIGS. 1 to 7, showing them assembled and showing the lock member in its locked position.
Figure 10:
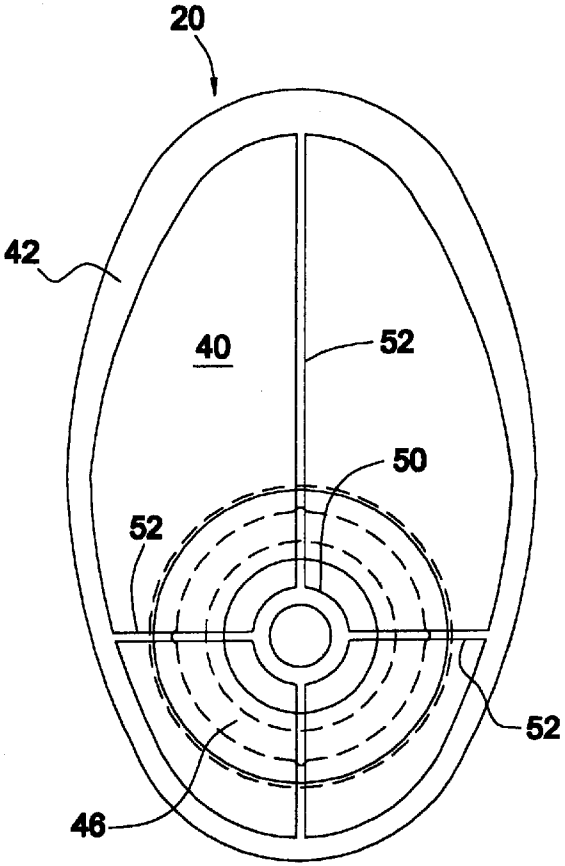
FIGS. 9 to 14 are views of the bracket member, as follows.

The handrail 12 can be completely pre-assembled before mounting it on the supports—unlike some previously known rails in which the covers cannot be mounted on the retainers until the retainers are attached to the wall. The rail is installed by loosely positioning it on the supports (FIG. 1) and then engaging the tool T with the faceted shank (FIG. 2) and rotating each lock member one-by-one from the unlocked position (FIG. 2) to the locked position (FIGS. 3 and 8). The detent between the lock member and the bracket helps the installer recognize when the lock member has reached the locked position. The forces of the frictional engagement between the lock members of the supports and the undercut groove in the rail firmly secure the rail to the supports and also, together with the detents, keep the lock members from rotating from the locked positions.

If it should be necessary to remove the rail from the supports, that can readily be done by simply rotating the lock members to the unlocked positions and separating the rail from the supports (see FIG. 1). The faceted shanks of the lock members are readily accessible to the tool T for that purpose. Other forms of tools and tool-engaging structures on the lock member may be substituted for the wrench and facets of the embodiment.

The rails and supports of the present invention are suitable for rails that include a metal retainer with handgrips and/or bumpers of wood, metal, or composite materials, and with all metal or wood rails.

FIGS. 23 to 31 show a lock member 22 that is the same in most respects as the lock member shown in FIGS. 15 to 22. Accordingly, the reference numerals referred to above in connection with the embodiment of FIGS. 15 to 22 are used for the last two digits of the reference numerals used for the corresponding structures of FIGS. 23 to 31, and the following description is limited to the differences.

The embodiment of FIGS. 23 to 31 provides an increased area of engagement, as compared with the embodiment of FIGS. 15 to 22, between each lock member 122 and the retainer 14 by modifications of the shank 162 that joins the locking cam portion 160 and the mounting base portion 164. The shank 162 includes a shoulder-forming part 162*s* and a groove-forming part 162*g*. When the lock member is in the installed condition in which it locks the rail 12 to the bracket by frictional engagement of the locking portions 166 of the cam portion 160 in the recesses 14*r* of the undercut groove 14*g* of the retainer, the following engagements (in addition to the engagements of the locking portions 166 with the recesses 14*r*) are provided: 1) segments along the upper and lower ends of the shoulder-forming part 162*s* engage the rear surfaces of the flanges 14*f* at engagement areas 180; and 2) segments of the inturned lip portions of the flanges 14*f* of the retainer 14 are received in upper and lower grooves 182 formed between the front surfaces of the locking portions 166 of the cam portion 160 and the rear surfaces of the shoulder-forming part 162*s* (see FIG. 31). The additional engagement areas distribute load transfers between the rail and the lock members over a greater area as compared to the embodiment of FIGS. 15 to 22.

The shoulder-forming part 162*s* and the groove-forming part 162*g* have facets 162*sf* and 162*gf* that are contiguous and have a widthwise (in the installed condition) spacing that is less than the vertical spacing of the inner most edges of the lips of the flanges 14*f* of the undercut groove 14*g* of the retainer 14. Accordingly, the shank 162 can be received between the inner extremities of the inturned lips of the flanges 14*f* so that the retainer can be hung from the installed brackets and lock members with the lock members in the release positions (see FIGS. 1 and 2) in the same manner as the embodiment of FIGS. 15 to 22. A wrench T (see FIG. 2) can be applied to either of the facets 162*sf* and 162*gf* in order to rotate the lock member 122 between the unlocked and locked positions.

The front surfaces of the locking portion 166 of the locking cam portion 160 engage upper and lower portions of the base surface of the undercut groove at engagement regions 184 (see FIG. 31). Protuberances in the form of small ribs 186 are provided on the locking portions 166. In the installed condition, the ribs are elastically compressed and provide preloads for maintaining the locking cam portion in firm engagement within the recesses 14*r*.

What is claimed is:

1. A rail and supports therefor comprising an elongated rail having an axis, an undercut groove of a uniform generally "C" shape in cross section extending axially along the rail, and a plurality of supports attached to the rail in spaced-apart relation, each support including a bracket member having a supported surface adapted to engage a structure on which the rail is mounted and having a supporting surface spaced apart from the supported surface, a lock member received on the supporting surface of the bracket member, the lock member having a locking cam portion received in the undercut groove, the locking cam portion having a size and shape such that it can enter the undercut groove when it is in an unlocked rotational position relative to the undercut groove and such that it frictionally engages walls of the undercut groove in a locked rotational position relative to the undercut groove and thereby retains the rail against displacement relative to the structure, and a fastener joining the lock member to the bracket member against displacement of the lock member relative to the bracket member and for rotation of the lock member relative to the bracket member.

2. The rail and supports therefor according to claim 1, wherein the lock member of each support includes a mounting base portion engaging the supporting surface of the bracket member.

3. The rail and supports therefor according to claim 2, wherein the lock member of each support includes a shank portion located between the cam portion and the mounting base portion.

4. The rail and supports therefor according to claim 1, wherein the lock member of each support has a tool-receiving formation on a portion thereof externally of the undercut groove adapted to receive a tool for use to facilitate rotating the lock member.

5. The rail and supports therefor according to claim 3, wherein the shank portion of the lock member of each support has a tool-receiving formation adapted to receive a tool for use to facilitate rotating the lock member.

6. The rail and supports therefor according to claim 4, wherein the tool-receiving formation is a peripheral surface of the lock member having facets adapted to be engaged by a wrench.

7. The rail and supports therefor according to claim 5, wherein the tool-receiving formation is a peripheral surface of the shank portion having facets adapted to be engaged by a wrench.

8. The rail and supports therefor according to claim 1, wherein the undercut groove of the rail has spaced apart walls forming recesses that face each other and the locking cam portion of the lock member of each support includes locking portions that frictionally engage the walls forming the recesses in the locked position of the lock member.

9. The rail and supports therefor according to claim 8, wherein the locking cam portion of the lock member of each support further includes a tapered lead-in portion adjacent each of the locking portions, the lead-in portions guiding the locking portions into engagement with the walls forming the recesses of the undercut groove upon rotation of the lock member from the unlocked position to the locked position.

10. The rail and supports therefor according to claim 3, wherein the undercut groove of the rail has spaced apart has L-shaped flanges having inturned lip portions forming recesses that face each other, the locking cam portion of the lock member of each support includes locking portions that frictionally engage the recesses in the locked position of the lock member, and the shank of the lock member includes a shoulder-forming part and a groove-forming part configured such that when the lock member is in the locked condition segments along the upper and lower ends of the shoulder-forming part engage rear surfaces of lip portions of the inturned flanges and the inturned lip portions of the flanges of the retainer are received in upper and lower grooves formed between front surfaces of the locking portions of the locking cam portion of the lock member and rear surfaces of the shoulder-forming part.

11. The rail and supports therefor according to claim 9, wherein front surfaces of locking portions of the locking cam portion of the lock member engage upper and lower portions of a base surface of the undercut groove at engagement regions and the front surfaces of the locking cam portion have protuberances that are elastically compressed and provide preloads for maintaining the locking cam portion in firm engagement within the recesses.

12. The rail and supports therefor according to claim 1, wherein the lock member is unitary and of a substantially rigid solid material.

13. The rail and supports therefor according to claim 1, wherein the lock member and bracket member of each support have interacting detents establishing the unlocked and locked positions of the lock member.

14. The rail and supports therefor according to claim 1, wherein the fastener of each support is adapted to fasten the bracket member to the structure.

15. The rail and supports therefor according to claim 14, wherein the fastener of each support is received within the bracket member along its entire extent between the supported surface and the supporting surface.

16. The rail and supports therefor according to claim 1, wherein the bracket member of each support includes a recessed socket in the supporting surface and the lock member includes a base portion received in nested relation in the socket.

17. The rail and supports therefor according to claim 16, wherein the recessed socket of the bracket member and the base portion of the lock member have interacting detents establishing the unlocked and locked positions of the lock member.

18. The rail and supports therefor according to claim 1, wherein the rail has a retainer of extruded aluminum and a cover of a polymeric material received on a portion of the retainer located to face away from the wall, and wherein the undercut groove is located on a portion of the retainer that faces toward the wall and is not covered by the cover.

* * * * *

UNITED STATES PATENT AND TRADEMARK OFFICE

CERTIFICATE OF CORRECTION

PATENT NO. : 6,508,458 B1
DATED : January 21, 2003
INVENTOR(S) : Bartlett et al.

It is certified that error appears in the above-identified patent and that said Letters Patent is hereby corrected as shown below:

Title page,
Item [73], Assignee, "Specialities" should read -- Specialties --

Column 4,
Lines 40, 49, 50, 61 and 62, "cross sectional" should read -- cross-sectional --

Column 6,
Line 58, "(FIG. 1)." should read -- (FIG. 1)). --

Column 9,
Line 2, "has" (second occurrence) should be deleted

Signed and Sealed this

Eighth Day of July, 2003

JAMES E. ROGAN
*Director of the United States Patent and Trademark Office*